US011757240B1

(12) United States Patent
Russell et al.

(10) Patent No.: US 11,757,240 B1
(45) Date of Patent: Sep. 12, 2023

(54) VARIABLE SPACING ELECTRICAL ADAPTER

(71) Applicants: Jeffrey Robert Russell, Winston Salem, NC (US); Brandon Wayne Blakely, Burlington, NC (US); Nicholas Stadler, Browns Summit, NC (US)

(72) Inventors: Jeffrey Robert Russell, Winston Salem, NC (US); Brandon Wayne Blakely, Burlington, NC (US); Nicholas Stadler, Browns Summit, NC (US)

(73) Assignee: Camco Manufacturing, LLC, Greensboro, NC (US)

( * ) Notice: Subject to any disclaimer, the term of this patent is extended or adjusted under 35 U.S.C. 154(b) by 132 days.

(21) Appl. No.: 17/447,097

(22) Filed: Sep. 8, 2021

(51) Int. Cl.
*H01R 31/06* (2006.01)
*H01R 13/707* (2006.01)
*H01R 13/04* (2006.01)

(52) U.S. Cl.
CPC ..... *H01R 31/06* (2013.01); *H01R 13/04* (2013.01); *H01R 13/707* (2013.01)

(58) Field of Classification Search
CPC ..... H01R 27/00; H01R 29/00; H01R 31/06; H01R 13/04; H01R 13/707
See application file for complete search history.

(56) References Cited

U.S. PATENT DOCUMENTS 3,034,084 A * 5/1962 Schmier ..... H01R 31/02 439/652
4,934,962 A * 6/1990 Luu ..... H01R 31/02 439/651
5,004,435 A * 4/1991 Jammet ..... H01R 25/006 439/652
5,159,545 A * 10/1992 Lee ..... H02M 5/12 439/103
5,211,584 A * 5/1993 Lee ..... H01R 25/006 439/652
5,383,799 A * 1/1995 Fladung ..... H01R 25/006 439/652

(Continued)

OTHER PUBLICATIONS

Wepbage printout from Amazon.com showing "(3xPCS) Right Angle Nema 5-15P 15A 125V AC Plug, [UL CUL] Easy Assembly 90 Degree USA Canada Male DIY Rewirable 12 Directions Adjustable AC Connector" including a close-up of the rotatable positions available (p. 9 of the printout), no copyright date, date first available: Apr. 17, 2019, found under Additional Information on p. 3.

*Primary Examiner* — Thanh Tam T Le
(74) *Attorney, Agent, or Firm* — Tuggle Duggins P.A.; Blake P. Hurt

(57) ABSTRACT

An electrical adapter including one stationary, 15 amp terminal blade and ground pin and one movable, 15 amp terminal blade and ground pin, each in connection with a 30 amp terminal receptacle and terminal ground receptacle, respectively. The 15 amp terminal blades and ground pins provide a mechanism to convert an electrical signal between the 30 amp source and the 15 amp source, and the adjustable 15 amp terminal blade and ground pin provide functionality to account for the difference in distance between the outlets on a standard 15 amp outlet and a 15 amp ground fault circuit interrupter (GFCI) outlet.

20 Claims, 8 Drawing Sheets

(56) References Cited

U.S. PATENT DOCUMENTS

| | | | | |
|---|---|---|---|---|
| 6,302,717 | B1 * | 10/2001 | Cheung | H01R 31/06 439/694 |
| 6,790,062 | B1 * | 9/2004 | Liao | H01R 13/72 439/501 |
| 6,935,878 | B2 * | 8/2005 | Hsu | H01R 13/44 439/174 |
| 7,052,298 | B1 * | 5/2006 | Cheng | H01R 31/065 439/651 |
| 8,390,404 | B2 * | 3/2013 | Zou | H01R 13/7135 361/42 |
| 10,389,059 | B1 * | 8/2019 | Li | H01R 31/065 |
| 10,566,162 | B2 * | 2/2020 | Long | H01R 13/713 |
| 10,587,084 | B1 * | 3/2020 | Shen | H01R 31/06 |
| 10,686,285 | B2 * | 6/2020 | Cai | H01R 13/631 |
| 10,770,844 | B2 * | 9/2020 | Nie | H01R 13/5816 |
| 10,840,627 | B1 * | 11/2020 | Su | H01R 13/15 |
| 10,874,637 | B2 * | 12/2020 | Rötig | A61K 31/00 |
| 10,992,093 | B1 * | 4/2021 | Lee | H01R 31/06 |
| 11,296,468 | B2 * | 4/2022 | Cheng | H01R 31/06 |

* cited by examiner

VARIABLE SPACING ELECTRICAL ADAPTER

FIELD OF THE INVENTION

The invention herein pertains to an electrical accessory generally, and particularly pertains to a double 15 amp male, 30 amp female electrical adapter, with at least the prongs of one of the amp male assemblies configured to displace in one or more direction(s).

DESCRIPTION OF THE PRIOR ART AND OBJECTIVES OF THE INVENTION

An electrical adapter typically refers to any circuitry or device that converts characteristics of one electrical signal, device, or system to those of an otherwise incompatible device or system. Some adapters have the ability to modify power or signal characteristics, while others merely adapt the physical form of one connector to another. In general, an adapter enables one type of device to communicate with another. This can be especially helpful when, for example, a non-15 amp source, such as a 30 amp source, needs to be plugged into a 15 amp source. It thus becomes necessary to use an adapter to communicate and convert the electrical signal between the 30 amp source and the 15 amp source.

Given the fact that the distance between the outlets on a standard 15 amp outlet vary from the distance between a 15 amp ground fault circuit interrupter (GFCI) outlet, prior inventions have been incompatible and non-functional when addressing the need for a single device to accommodate both outlets. Therefore, the present invention relates to an adapter with double 15 amp male plugs to a 30 amp female, whereby the male terminals are adjustable. Prior 15 amp male plug to 30 amp female adapters are incapable of adjusting whereas the present invention advantageously adjusts. Though some travel electrical adapters are known in the art, these do not move as taught by the present invention. Further, the current invention may be modified to fit both a standard 15 amp outlet and a 15 amp GFCI outlet. Additionally, two 15 amp connections sharing an electrical load will result in the present invention running cooler than prior art devices that may otherwise create excessive heat. Further still, there is also a need for a plug that is less likely to unplug itself. Considering its structure and design, the present invention is more stable and becomes a solution to this troubling problem.

Thus, in view of the problems and disadvantages associated with prior art devices, the present invention was conceived and one of its objectives is to provide an electrical adapter that includes multiple 15 amp male assemblies.

It is another objective of the present invention to provide an electrical adapter that includes at least one 15 amp male assembly that can move from a first position to a second position.

It is still another objective of the present invention to provide an electrical adapter that includes at least one 15 amp male assembly configured to displace along an axis from a first position to a second position.

It is yet another objective of the present invention to provide an electrical adapter that includes first, second, and third inner housings, the first inner housing comprising an adjustable, amp terminal blade and an adjustable, 15 amp ground pin; the second inner housing comprising a 30 amp terminal receptacle and a 30 amp terminal ground receptacle; and the third inner housing comprising a static, 15 amp terminal blade and a static, 15 amp ground pin.

It is a further objective of the present invention to provide an electrical adapter including an outer housing assembly, the outer housing assembly formed from a cover and a base, the cover further defining one or more guides for maintaining a switch about the midline of the adapter when the adjustable terminal blade and the adjustable ground pin are displaced.

It is still a further objective of the present invention to provide an electrical adapter with amp terminal blades and pins all being formed from conductive and/or brass/copper construction.

It is yet a further objective of the present invention to provide an electrical adapter including the first, second, and third inner housings in communication with one or more wires, the one or more wires coated with a synthetic material such as silicone to facilitate movement of the adjustable housing.

Various other objectives and advantages of the present invention will become apparent to those skilled in the art as a more detailed description is set forth below.

SUMMARY OF THE INVENTION

The aforesaid and other objectives are realized by providing a variable spacing electrical adapter for converting electrical current between 15 and 30 amp source(s) including an outer housing assembly formed from a cover and a base, and an internal assembly positioned within the housing assembly, the internal assembly defined by a first housing, a second housing, and a third housing, the respective housings in communication with one another. The base and the cover of the housing assembly each define a front face and an open back face. The first housing carries an adjustable, 15 amp terminal blade and an adjustable, 15 amp ground pin. The second housing includes a 30 amp terminal receptacle and a 30 amp terminal ground receptacle. The third housing carries a static, 15 amp terminal blade and a static, 15 amp ground pin. The first, second, and third housings are connected with a plurality of wires via the adjustable terminal blade, the adjustable ground pin, the terminal receptacle, the terminal ground receptacle, the static blade, and the static ground pin, respectively. The adjustable terminal blade and the adjustable ground pin are configured to be displaced along a first axis as demonstrated by the present invention.

In the preferred embodiment of the variable spacing electrical adapter, the front face of the cover defines a flat upper portion and a protruding cylindrical lower portion. The flat upper portion defines an orifice, positioned along a midline of the cover, the orifice is sized and shaped for a switch located on the first housing to pass through. The switch is in communication with the adjustable terminal blade and the adjustable ground pin and facilitates the adjustable terminal blade and the adjustable ground pin to slidably move about the first axis as described above. Furthermore, the cover defines one or more switch guides for maintaining the switch about the midline when the adjustable terminal blade and the adjustable ground pin are displaced.

DETAILED DESCRIPTION OF THE PREFERRED EMBODIMENT AND OPERATION OF THE INVENTION

Figure 1:
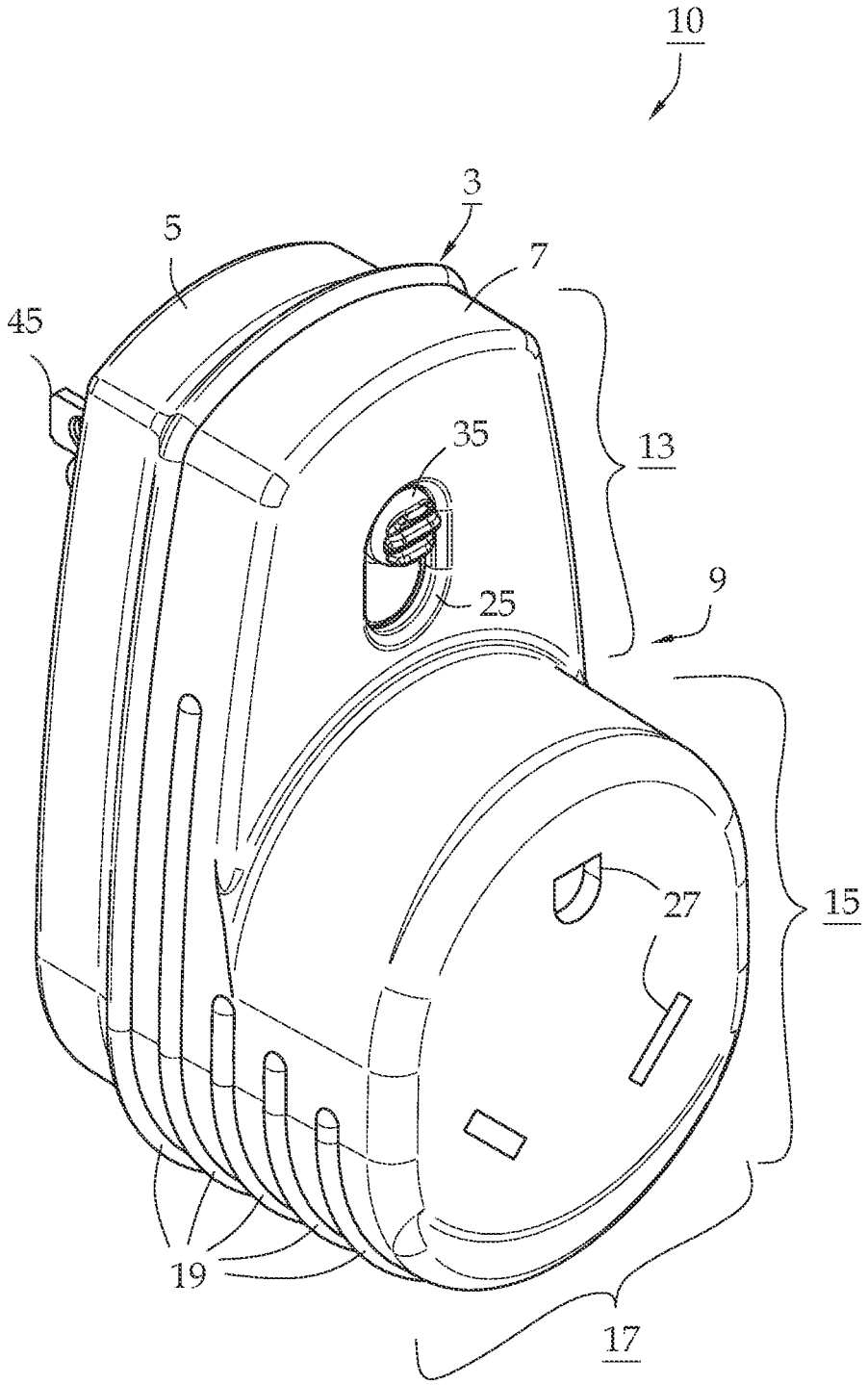
FIG. 1 shows a perspective view of the electrical adapter of the instant disclosure.

Various exemplary embodiments of the present disclosure are described below. Use of the term "exemplary" means illustrative or by way of example only, and any reference herein to "the invention" is not intended to restrict or limit the invention to exact features or step of any one or more of the exemplary embodiments disclosed in the present specification. References to "exemplary embodiment", "one embodiment", "an embodiment", "various embodiments", and the like may indicate that the embodiment(s) of the invention so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

The present invention is described more fully hereinafter with reference to the accompanying figures, in which one or more exemplary embodiments of the invention are shown. Like numbers used herein refer to like elements throughout. The invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the invention, and any and all equivalents thereof. Moreover, many embodiments such as adaptations, variations, modifications, and equivalent arrangements will be implicitly disclosed by the embodiments described herein and fall within the scope of the instant invention.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry ad without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has previously been reduced to practice or that any testing has been performed. Likewise, unless stated otherwise, use of verbs in the past tense (present perfect or preterit) is not intended to indicate or imply that the invention has previously been reduced to practice or that any testing has been performed.

For a better understanding of the invention and its operation, turning now to the drawings, FIGS. 1-8 illustrate various views of the preferred embodiment of variable spacing electrical adapter 10. Throughout the description and illustrations, variable spacing electrical adapter 10, as seen in FIGS. 1-8, is represented as a variable spacing electrical adapter 10 for converting electrical current between 15 and 30 amp source(s) including a housing assembly 3 formed from a cover 7 and a base 5, and an internal assembly 37 (best seen in FIG. 8) positioned within the housing assembly 3. The internal assembly 37 may be formed from a first housing 39 and second housing 41; however the preferred embodiment includes an additional, third housing 43. In one embodiment, the first housing 39 and second housing 41 are in communication with one another, whereas in the preferred embodiment, the first housing 39, second housing 41, and third housing 43 are in communication with one another. The first, second, and third housings 39, 41, and 43 are connected with a plurality of wires 59, 61, and 63, respectively, via one or more of the adjustable, amp terminal blade 45, the adjustable, 15 amp ground pin 47, the 30 amp terminal receptacle 49 (FIG. 6), the 30 amp terminal ground receptacle 51 (FIG. 6), the static, 15 amp terminal blade 53, and the static, 15 amp ground pin 55, respectively. The adjustable, 15 amp terminal blade 45, and the adjustable, 15 amp ground pin 47 are preferably configured to be displaced along a first axis by use of a switch 35 as demonstrated by the present disclosure; provided however that in certain embodiments of adapter 10, it may be understood that one of the adjustable, 15 amp terminal blade 45 and the adjustable, 15 amp ground pin 47 may be deployed without the other element. In one, non-limiting example, the adjustable, 15 amp terminal blade 45, and the adjustable, 15 amp ground pin 47 are configured to move as demonstrated in FIG. 6 along a longitudinal axis A defined by the adapter 10 between a first position B and a second position C shown in broken line.

Figure 2:
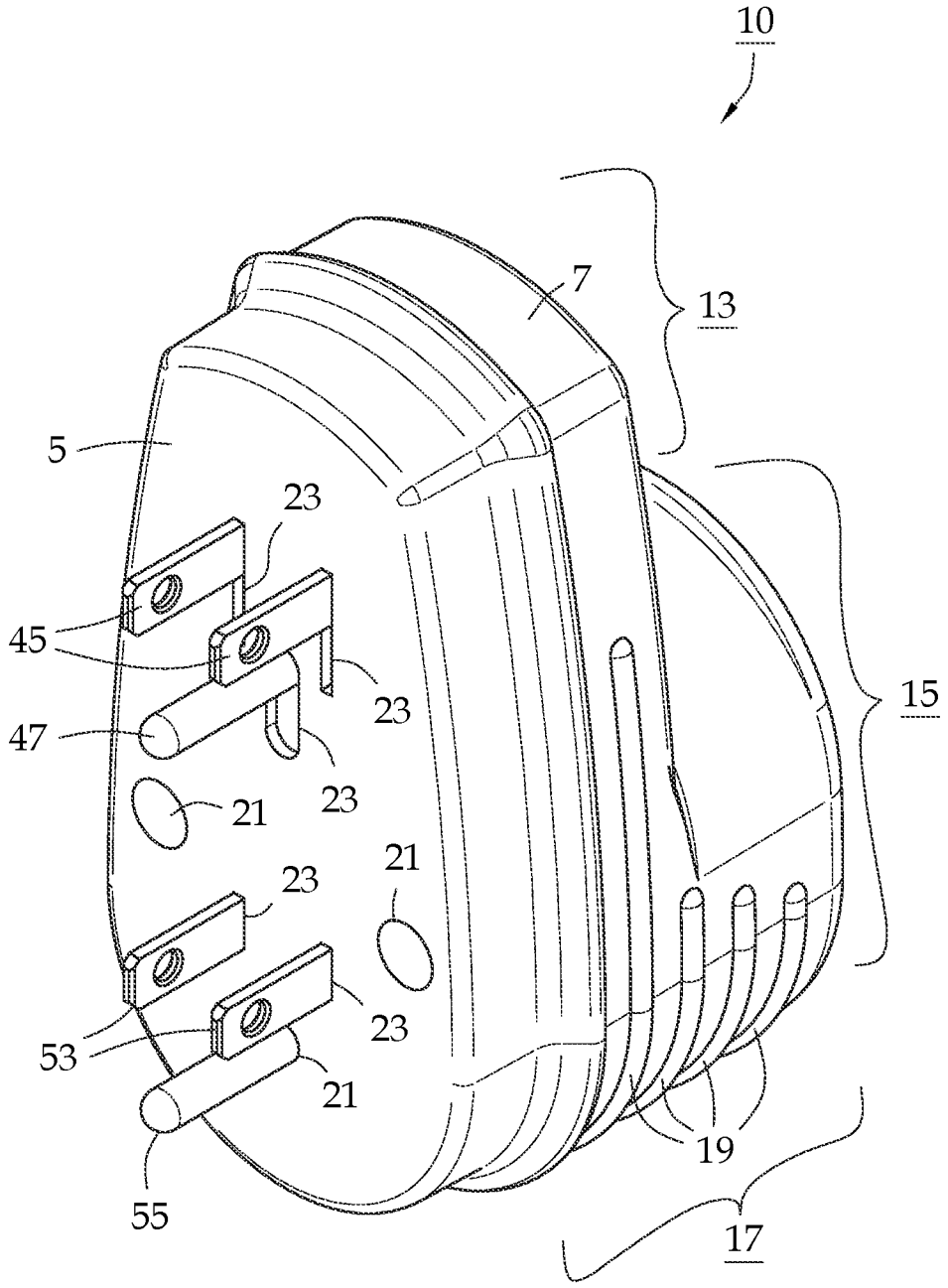
FIG. 2 pictures an alternate perspective view of the adapter of FIG. 1.

As demonstrated in FIGS. 1 and 2, the front face 9 may define a flat upper portion 13 and a protruding cylindrical lower portion 15. The flat upper portion 13 preferably defines an orifice 25, ideally located along a midline of the cover 7 and sized and shaped for the switch 35 to pass through (shown at least in FIGS. 1, 4, and 6). As pictured in FIGS. 3 and 5, the embodiment of protruding cylindrical lower portion 15 includes several curved ridges 19 positioned along a portion of the sides and a bottom 17 of the lower portion 15 for easy grip by users. It is a preference for bottom 17 to include four curved ridges 19 evenly spaced apart with varying lengths. The protruding cylindrical lower portion 15 also includes at least two apertures 27 wherein a 30 amp terminal receptacle 49 is coplanar with one of the apertures 27 and a 30 amp terminal ground receptacle 51 is coplanar with the other of the apertures 27. The aperture 27 which is coplanar with the 30 amp terminal ground receptacle 51, is preferably positioned towards the midline of the protruding cylindrical lower portion 15. It is a further preference for the aperture 27 which is coplanar with the 30 amp terminal ground receptacle 51, to be positioned above the 30 amp terminal receptacle 49.

Figure 6:
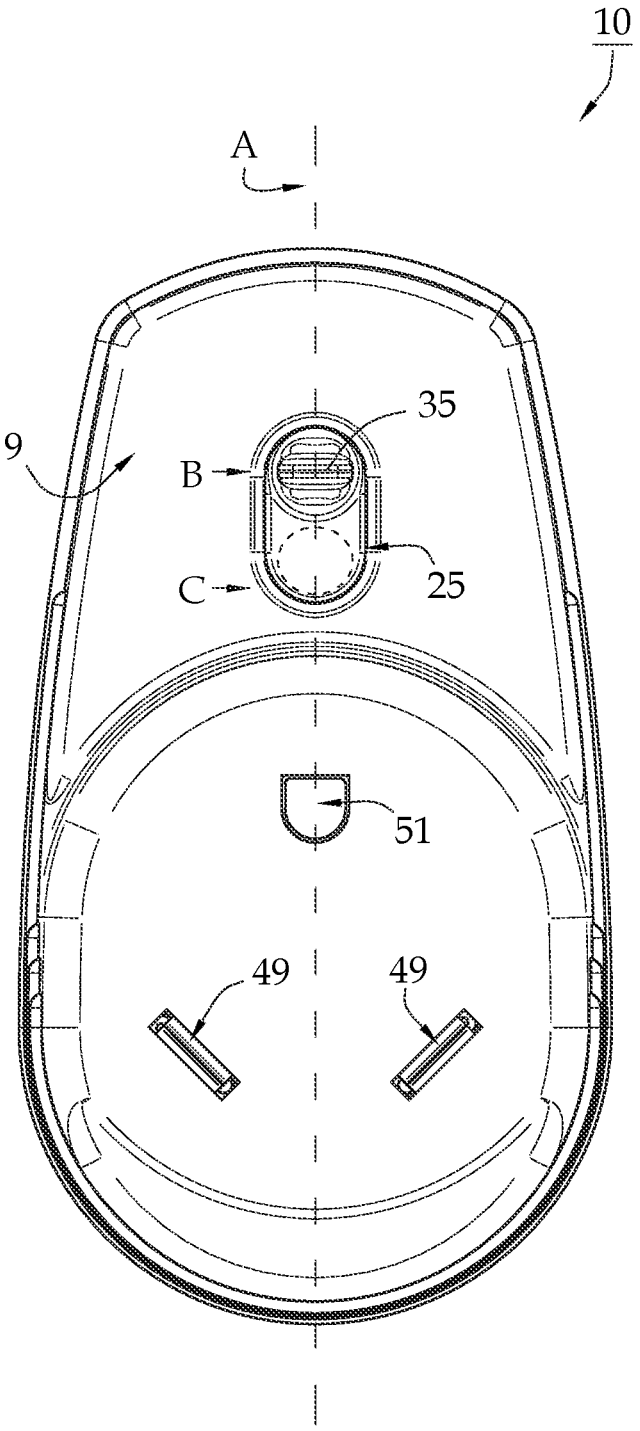
FIG. 6 features an elevated front view of the adapter of FIG. 1.
Figure 8:
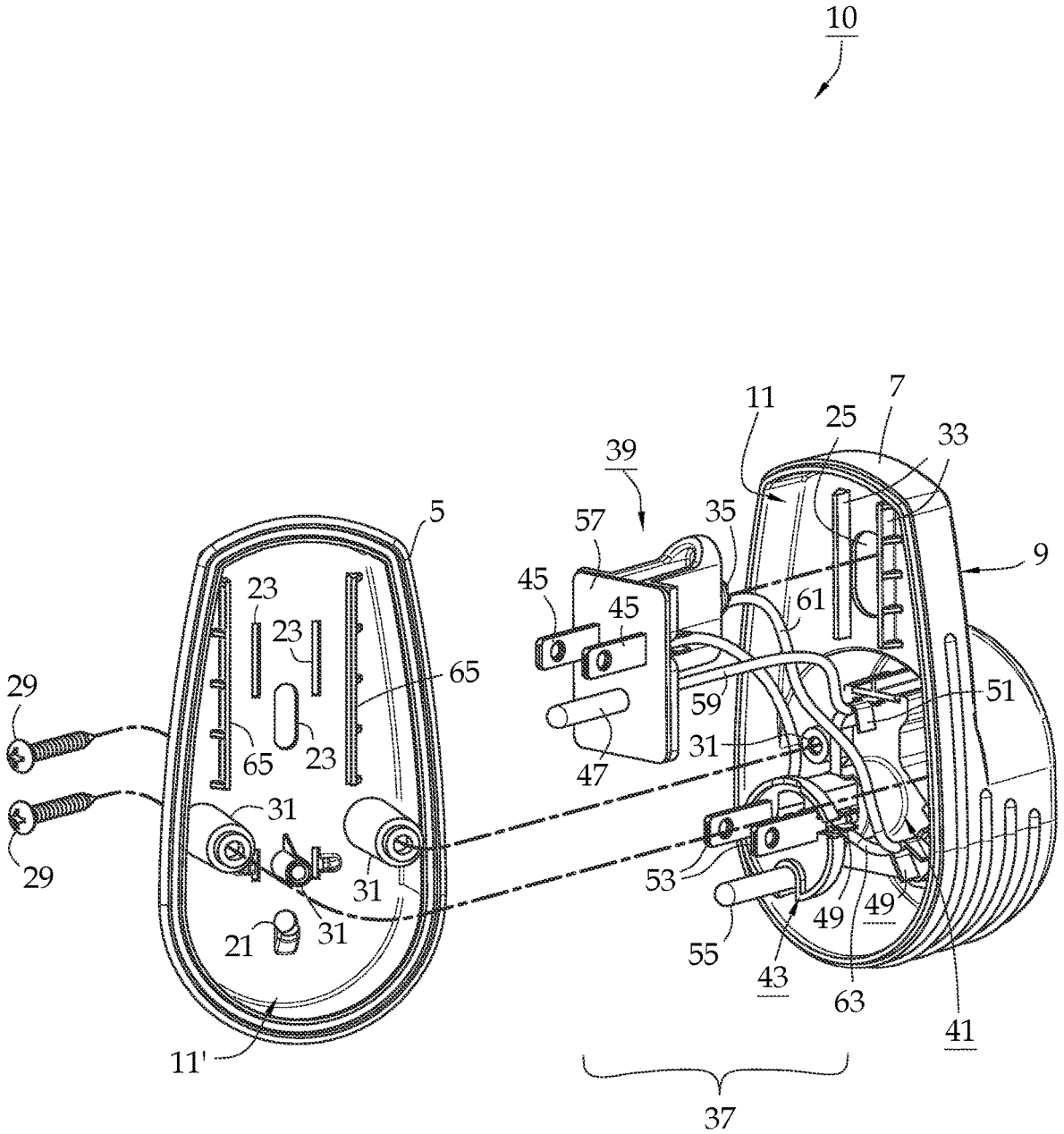
FIG. 8 illustrates an exploded perspective view of the adapter of FIG. 1.

In the preferred embodiment, cover 7 defines a total of three apertures 27. Of the three apertures 27, two apertures 27 are coplanar with two of the 30 amp terminal receptacles 49, and the third aperture 27 is positioned above the other two apertures 27 as seen in FIG. 6. The three apertures 27 are positioned on the protruding lower portion 15 of the cover 7, preferably in the shape of a triangle as pictured in FIGS. 1 and 6. It is also a preference for the open back face 11 of cover 7 to define one or more switch guides 33 as seen in FIG. 8 for maintaining the switch 35 about the midline when the adjustable, 15 amp terminal blade 45 and the adjustable, 15 amp ground pin 47 are displaced along a first axis. It is preferred for the open back face 11 of cover 7 to include two switch guides 33, one of each positioned in opposing relation relative to the midline. The open back face 11 of cover 7 is further defined by one or more bosses 31 for the receipt of one or more attachment members 29 configured to secure the base 5 to the cover 7. It is also a preference for the color of the cover 7 to be yellow, but may define other colors as desirable. In one embodiment, cover 7 is made from thermoplastic or some other form of durable polymeric material, however, the material is not considered a limitation of the instant disclosure.

Figure 7:
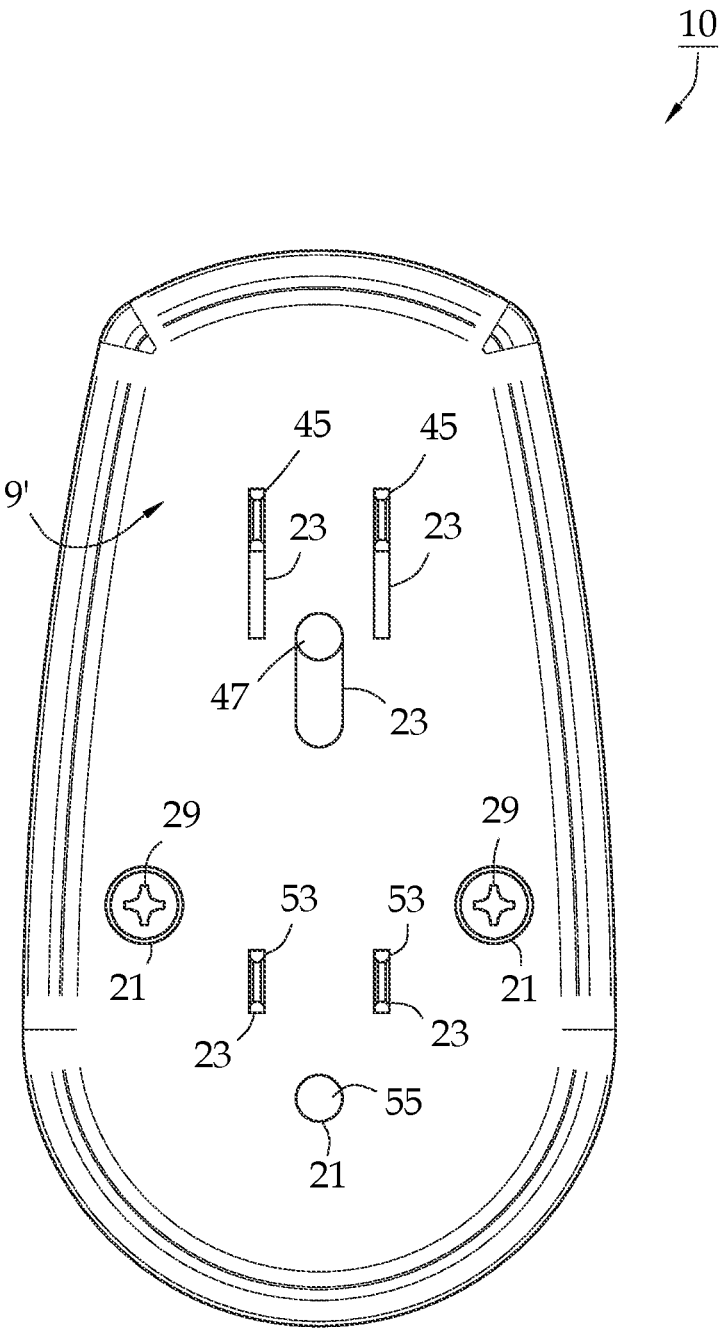
FIG. 7 shows an elevated rear view of the adapter of FIG. 1.

In one preferred embodiment, the housing assembly 3 is formed from a cover 7 and a base 5. As depicted in FIGS. 7 and 8, it is desirous for the base 5 to include a front face 9' and an open back face 11'. The front face 9' of base 5 is preferably planar and defines a number of elongated slots 23 sized and shaped for receipt of an adjustable, 15 amp terminal blade 45, a static, 15 amp terminal blade 53, and adjustable, 15 amp ground pin 47. It is preferable for the base 5 to include five elongated slots 23. There may be two, 0.6 inch elongated slots 23 for two of the adjustable, amp terminal blades 45, sized, shaped, and otherwise configured to enable movement of the two adjustable, 15 amp terminal blades 45. It is also a preference for the elongated slot 23 for the adjustable, 15 amp ground pin 47 to be 0.56 inches long, measured to enable movement of the adjustable, 15 amp ground pin 47, and for the elongated slot 23 to be configured into an ovular shape. These measurements are not to be construed as limitations of the present disclosure.

One preferred embodiment of the front face 9' of base 5 defines a circular hole 21 for a static, 15 amp ground pin 55 and two circular holes 21 for attachment members 29. The attachment members 29 are preferably screws but may include other attachment members known in the art. The two holes 21 for the attachment members 29 may be larger than the hole 21 for the static, 15 amp ground pin 55. The holes 21 for the attachment members 29 are preferably positioned along the edge of the base 5. One of each of the holes 21 for the attachment members 29 positioned in opposing relation relative to the midline as pictured in FIGS. 2, 7, and 8. The open back face 11' of base 5 preferably includes several bosses 31 for the receipt of attachment members 29 which secure the base 5 to the cover 7. The open back face 11' of base 5 preferably defines three cylindrically shaped bosses 31 to hold three attachment members 29. While not shown as would be understood one attachment member 29 is received within second housing 41, third housing 43 and into boss 31 of open back face 11' of base 5 to prevent movement therebetween. It is also preferable for the open back face 11' of base 5 to include two first housing guides 65 for maintaining the first housing 39 via back plate 57 about the midline when the adjustable, 15 amp terminal blade 45 and the adjustable, 15 amp ground pin 47 are displaced using the switch 35. The base 5 is preferably black but may include other colors. Preferably, base 5 is made from thermoplastic or some other form of durable polymeric material; however, the material is not considered a limitation of the instant disclosure.

In one embodiment, the internal assembly 37 consists of a first housing 39 and a second housing 41. In this embodiment, it is preferable for the first housing 39 to carry at least one adjustable, 15 amp terminal blade 45 and an adjustable, 15 amp ground pin 47. It is also a preference for the second housing 41 to hold at least one 30 amp terminal receptacle 49 and a 30 amp terminal ground receptacle 51. It is a preference for this embodiment to include two adjustable, 15 amp terminal blades 45 and two 30 amp terminal receptacle 49. Preferably, the first housing 39 includes a switch 35 that is in communication with the adjustable, 15 amp terminal blade 45 and the adjustable, 15 amp ground pin 47 permitting the adjustable, 15 amp terminal blade 45 and the adjustable, 15 amp ground pin 47 to move about a first axis. The adjustable, 15 amp ground pin 47 and 30 amp terminal ground receptacle 51 are preferably connected via a first wire 59 while the adjustable, 15 amp terminal blades 45 and the 30 amp terminal receptacles 49 are connected via a second wire 61. Furthermore, the adjustable, 15 amp terminal blades 45 and the adjustable, 15 amp ground pin 47 are configured to be displaced along a first axis as defined by the instant disclosure from a first position to a second position. In this embodiment, the base 5 does not include two elongated slots 23 for two static, 15 amp terminal blades 53. This embodiment also does not include the hole 21 for the static, 15 amp ground pin 55, as neither the static, 15 amp terminal blades 53 nor the static, 15 amp ground pin 55 is included in this embodiment. The first housing 39 and second housing 41 may preferably be connected into a unitary member using the first wire 59 and second wire 61 and positioned within the housing assembly 3.

In a second and more preferred embodiment, the internal assembly 37 includes a first housing 39, second housing 41, and third housing 43. In this preferred embodiment, the first housing 39 carries at least one adjustable, 15 amp terminal blade 45 and an adjustable, 15 amp ground pin 47. It is also preferable for the second housing 41 to hold at least one 30 amp terminal receptacle 49 and a 30 amp terminal ground receptacle 51. The third housing preferably holds at least one static, 15 amp terminal blade 53 and a static, 15 amp ground pin 55. It is a preference for the first housing 39 to carry two adjustable, 15 amp terminal blades 45, for the second housing 41 to carry two 30 amp terminal receptacles 49, and for the third housing 43 to carry two static, 15 amp terminal blades 53.

Figure 3:
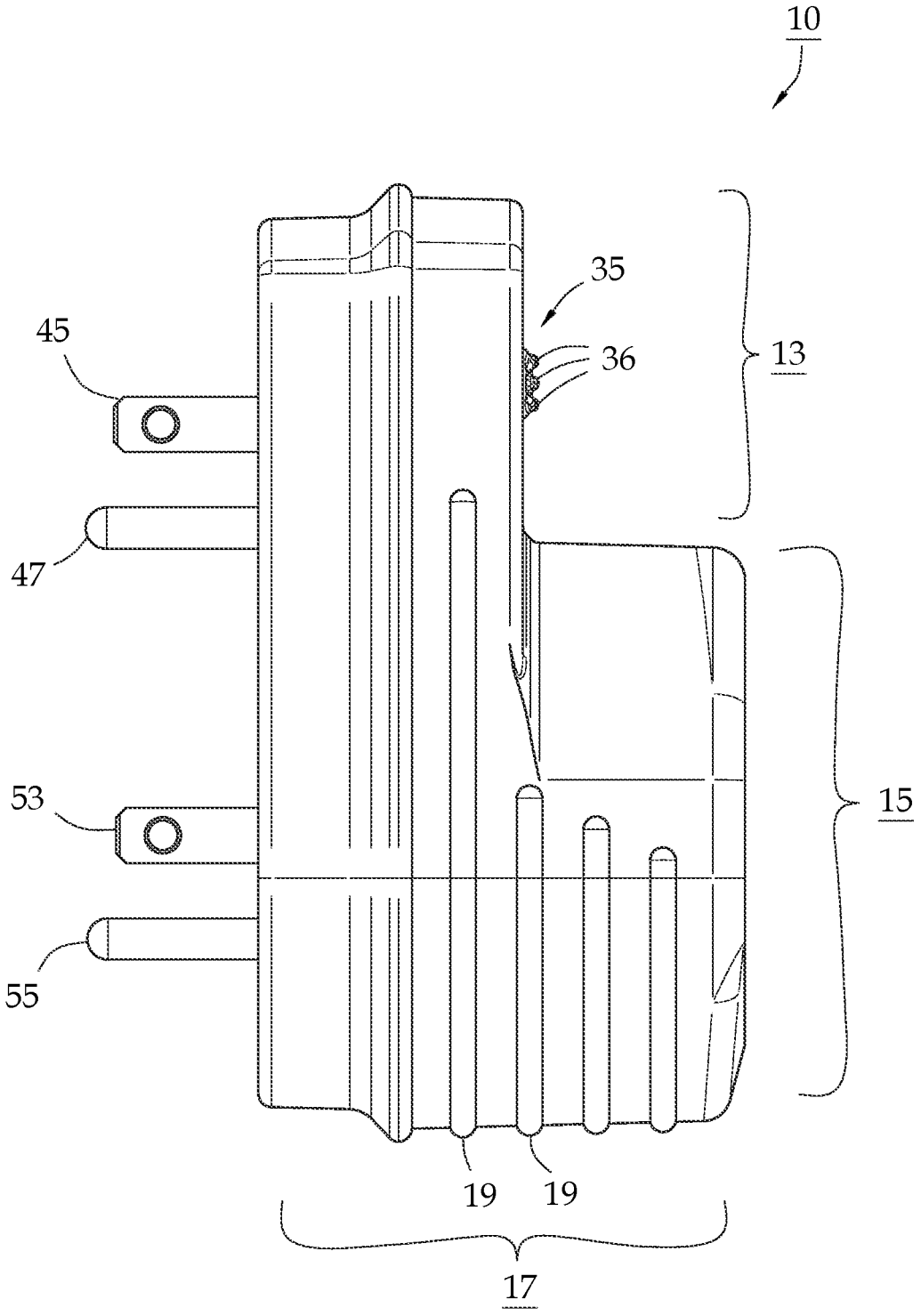
FIG. 3 depicts an elevated side view of the adapter of FIG. 1, it being understood that the opposing side is a mirror image thereof.
Figure 4:
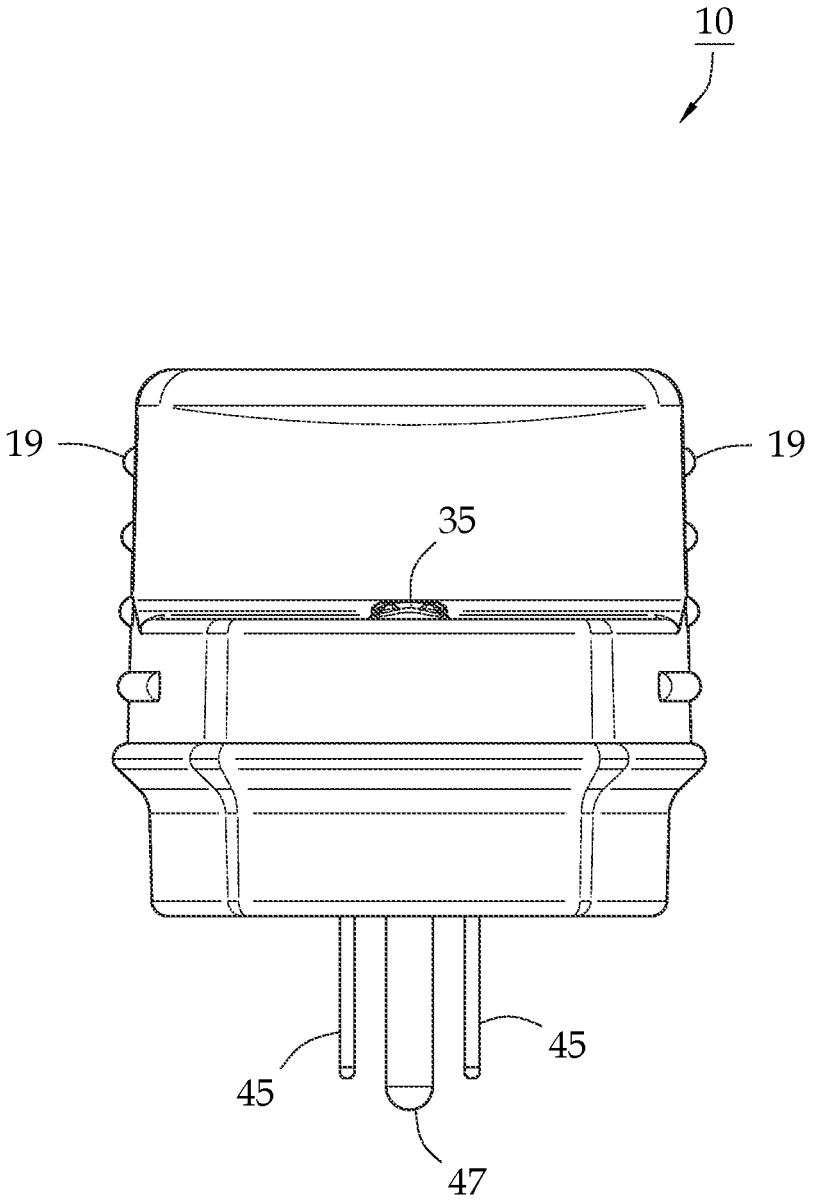
FIG. 4 demonstrates a top plan view of the adapter of FIG. 1.
Figure 5:
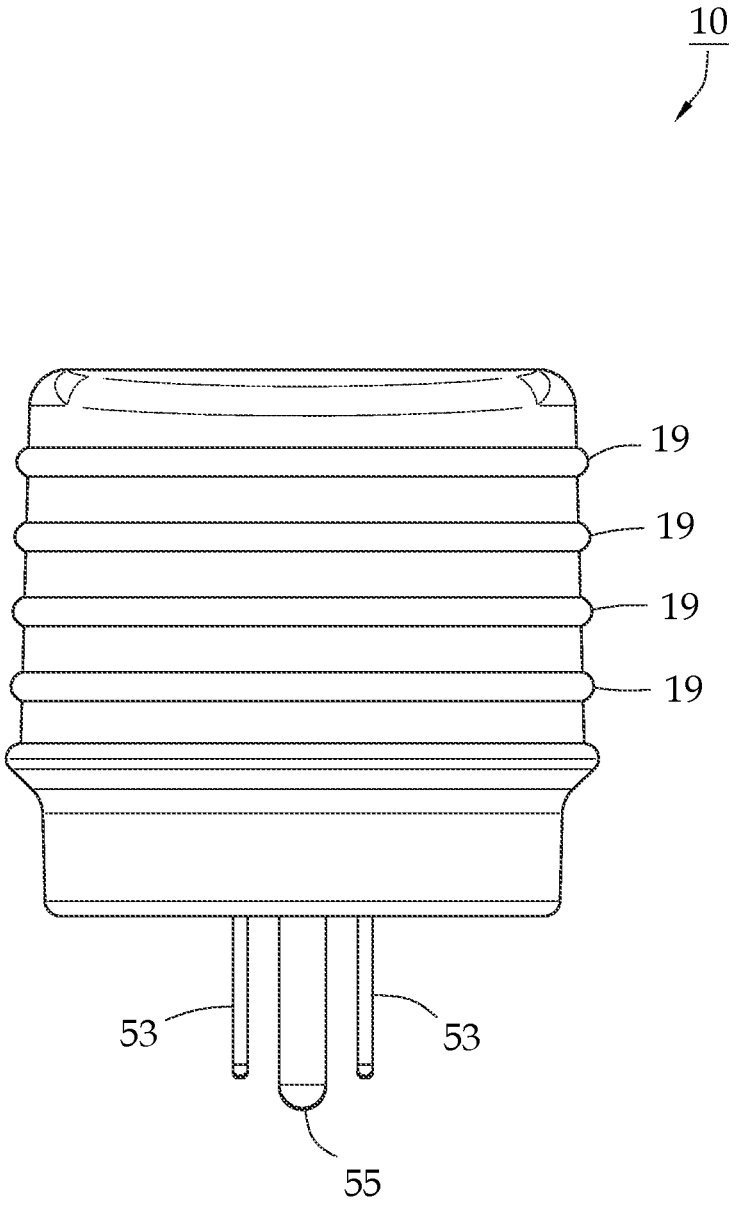
FIG. 5 illustrates a bottom plan view of the adapter of FIG. 1.

The adjustable, 15 amp ground pin 47 and the 30 amp terminal ground receptacle 51 may be connected via a first wire 59. The adjustable, 15 amp terminal blades 45 and 30 amp terminal receptacles 49 may be connected via a second wire 61. It is also preferable for the second housing 41 and third housing 43 to be connected via a third wire 63. It is a further preference for the first housing 39 to attach to a back plate 57 for securing the adjustable, 15 amp terminal blade 45 and adjustable, 15 amp ground pin 47. Back plate 57 is sized and shaped to be received and slide within first housing guides 65 on open back face 11" of base 5. In a preferred embodiment the terminals may be formed from conductive material such as metal, copper, silver, gold, wire, aluminum, steel, or other conductive materials as are known in the art. The preferred embodiment further includes a switch 35 positioned on the first housing 39, wherein the switch 35 is in communication with the adjustable, 15 amp terminal blades 45 and the adjustable, 15 amp ground pin 47 allowing the adjustable, 15 amp terminal blades 45 and the adjustable, 15 amp ground pin 47 to move about a first axis. As shown in FIGS. 3 and 6, the switch 35 preferably defines a circular shape and comprises several linear ridges 36 to assist in manipulation of switch 35. In the preferred embodiment, the first, second, and third housings 39, 41, and 43 define the internal assembly 37 and are connected into a unitary member using the first wire 59, second wire 61, and third wire 63 as pictured in FIG. 8.

During use as would be understood, adapter 10 is grasped and switch 35 is engaged and urged by a user's finger (not shown) downwardly along axis A to move switch 35 from first position B to second position C as seen in FIG. 6 simultaneously causing first housing 39 to slidably move within switch guides 33 of front cover 7 and first housing guides 65 of base 5 from the upper first position B to the lower second position C. To return first housing 39 to first position B, the user (now shown) would again engage and urge switch 35 upwardly along axis A from second position C.

In the preferred embodiment and as previewed in FIGS. 1, 7, and 8, the internal assembly 37 is positioned within the housing assembly 3, wherein the two adjustable, 15 amp terminal blades 45, adjustable, 15 amp ground pin 47, protruding from the back plate 57, and the two static, 15 amp terminal blades 53, and static, 15 amp ground pin 55 protrude from the base 5 of the housing assembly 3. Also in the preferred embodiment, when the internal assembly 37 is positioned within the housing assembly 3, the switch 35 protrudes from the orifice 25 located on the cover 7 of the housing assembly 3. It is a preference to secure the housing assembly 3 to the internal assembly 37 by screwing the two parts together. However, other methods of attachment may include bolting, nailing, hooking and looping, roping, taping, gluing, clamping, and the like. It is also a preference that the spacing within the housing assembly 3, as compared to the size of the internal assembly 37 be sufficient to allow for cooling of the variable spacing electrical adapter 10. When the housing assembly 3 and internal assembly 37 are securely attached, the variable spacing electrical adapter 10 is designed to convert electrical current between 15 and 30 amp source(s).

The illustrations and examples provided herein are for explanatory purposes and are not intended to limit the scope of the appended claims.

We claim:

1. A variable spacing electrical adapter comprising:

a housing assembly including a base and a cover; and an internal assembly positioned within the housing assembly, the internal assembly further comprising a first housing carrying an adjustable terminal blade, and a second housing holding a terminal receptacle and a terminal ground receptacle; the adjustable terminal blade and the terminal receptacle in communication via a first wire;

wherein the adjustable terminal blade protrudes from the base;

wherein the adjustable terminal blade is configured to be displaced along a first axis as defined by the variable spacing electrical adapter; and wherein the displacement of the adjustable terminal blade is relative to the housing assembly so as to configure the adjustable terminal blade to engage a plurality of configurations defined by a 15 amp outlet.

2. The variable spacing electrical adapter of claim 1 further comprising a back plate for securing the adjustable terminal blade.

3. The variable spacing electrical adapter of claim 1, wherein the internal assembly further comprises a third housing.

4. The variable spacing electrical adapter of claim 1, wherein the internal assembly further comprises a third housing holding a static terminal blade and a static ground pin.

5. The variable spacing electrical adapter of claim 4, wherein the second and third housings are in communication via a second wire, and wherein the first, second, and third housings define the internal assembly positioned within the housing assembly.

6. The variable spacing electrical adapter of claim 1, wherein the internal assembly further comprises a third housing holding a static terminal blade and a static ground pin, wherein the second housing and third housing are attached to one another.

7. The variable spacing electrical adapter of claim 1, wherein the cover further defines a front face and a back face, wherein the front face is further defined by a flat upper portion and a protruding cylindrical lower portion.

8. The variable spacing electrical adapter of claim 7 further comprising one or more curved ridges, the one or more curved ridges positioned along a bottom of the lower portion.

9. The variable spacing electrical adapter of claim 8, wherein the protruding cylindrical lower portion defines two apertures, the terminal receptacle coplanar with one of the apertures and the terminal ground receptacle coplanar with the other of the apertures.

10. The variable spacing electrical adapter of claim 9 further comprising a switch positioned on the first housing, wherein the flat upper portion defines an orifice sized and shaped to receive the switch therethrough.

11. The variable spacing electrical adapter of claim 10, wherein the cover is further defined by an open back face with one or more bosses for the receipt of one or more attachment members configured to secure the base to the cover.

12. The variable spacing electrical adapter of claim 1 further comprising the first housing carrying the adjustable terminal blade and an adjustable ground pin and a third housing holding a static terminal blade and a static ground pin, wherein the adjustable terminal blade, the adjustable ground pin, the static terminal blade, and the static ground pin protrude from the base.

13. The variable spacing electrical adapter of claim 12, wherein the base is further defined by an open back face with one or more bosses for the receipt of one or more attachment members configured to secure the base to the cover.

14. The variable spacing electrical adapter of claim 13, wherein the base defines a number of elongated slots for receipt of the adjustable terminal blade, the static terminal blade, and the adjustable ground pin and a hole for the static ground pin.

15. The variable spacing electrical adapter of claim 14 further comprising a switch positioned on the first housing, wherein the cover further defines a front face and a back face, wherein the front face is further defined by a flat upper portion and a protruding cylindrical lower portion, wherein the flat upper portion defines an orifice sized and shaped to receive the switch therethrough, and wherein the switch is in communication with the adjustable terminal blade and the adjustable ground pin.

16. The variable spacing electrical adapter of claim 15, wherein the orifice is situated along a midline of the cover.

17. The variable spacing electrical adapter of claim 16 further comprising one or more switch guides for maintaining the switch about the midline when the adjustable terminal blade and the adjustable ground pin are displaced along a first axis as defined by the variable spacing electrical adapter.

18. The variable spacing electrical adapter of claim 16, wherein the one or more switch guides are defined as two switch guides, one of each of the switch guides positioned in opposing relation relative to the midline.

19. The variable spacing electrical adapter of claim 3, wherein the second and third housings are in communication via a second wire, and wherein the first, second, and third housings define the internal assembly positioned within the housing assembly.

20. A variable spacing electrical adapter comprising:

a housing assembly including a base and a cover, wherein the base defines a front face and a back face, wherein the front face further defines an adjustable terminal blade, an adjustable ground pin, a static terminal blade, and a static ground pin, the front face further comprising a number of apertures for the receipt of one or more attachment members, and the base defining an open back face; the cover defines a front face further defined by a flattened upper portion and a protruding cylindrical lower portion, the lower portion having curved ridges along a bottom and a terminal receptacle and a terminal ground receptacle centered on the surface of the lower portion, the upper portion comprising a pivoting switch to modify the adjustable terminal blade and adjustable ground pin, the cover further defined by and an open back face with several apertures for the receipt of one or more attachment members to secure the base to the cover, wherein the back face is further defined by a number of elongated slots for receipt of the adjustable terminal blade and adjustable ground pin;

an internal assembly positioned within the housing assembly wherein the internal assembly comprises a first housing carrying an adjustable terminal blade and adjustable ground pin, whereby the first housing further comprises a back plate; the internal assembly further comprising a second housing holding a terminal receptacle and a terminal ground receptacle; the internal assembly further comprising a third housing holding a static terminal blade and static ground pin;

wherein the first housing carrying the adjustable terminal blade and adjustable ground pin is connected to the back face of the cover and is further attached to the back plate, wherein the adjustable terminal blade and adjustable ground pin protrude from the back plate and further protrude from the base of the housing assembly;

wherein the adjustable terminal blade and adjustable ground pin connect to a first and second wire whereby the first and second wire are further connected to the terminal receptacles positioned within the second housing;

whereby the first and second wires connect the first housing to the second housing;

whereby the second housing and the third housing are connected by means of attachment;

whereby the adjustable terminal blade and the adjustable ground pin are configured to be displaced along a first axis as defined by the variable spacing electrical adapter; and whereby the housing assembly and internal assembly are connected by one or more of the attachment members into a unitary member.

* * * * *